US007005037B2

(12) United States Patent
Weigant

(10) Patent No.: US 7,005,037 B2
(45) Date of Patent: Feb. 28, 2006

(54) DEVICE FOR DETACHING A PAPER WEB FROM A WIRE

(75) Inventor: Harald Weigant, Graz (AT)

(73) Assignee: Andritz AG, Graz (AT)

( * ) Notice: Subject to any disclaimer, the term of this patent is extended or adjusted under 35 U.S.C. 154(b) by 0 days.

(21) Appl. No.: 10/705,064

(22) Filed: Nov. 10, 2003

(65) Prior Publication Data

US 2004/0129399 A1 Jul. 8, 2004

(30) Foreign Application Priority Data

Nov. 11, 2002 (AT) ..... A 1692/2002

(51) Int. Cl.
*D21F 1/02* (2006.01)
*D21F 1/48* (2006.01)

(52) U.S. Cl. ..... 162/286; 162/301; 162/363; 162/358.3; 83/277

(58) Field of Classification Search ..... 162/286, 162/301–303, 358.3, 363, 111–113, 306–307, 162/310, 353; 83/53, 277
See application file for complete search history.

(56) References Cited

U.S. PATENT DOCUMENTS 3,625,814 A * 12/1971 De Noyer ..... 162/299
4,113,557 A * 9/1978 Kankaanpaa ..... 162/301
4,224,104 A * 9/1980 Kankaanpaa ..... 162/205
4,790,909 A * 12/1988 Harwood ..... 162/301
4,925,531 A * 5/1990 Koski ..... 162/301
5,164,045 A * 11/1992 Awofeso et al. ..... 162/101
5,695,607 A * 12/1997 Oriaran et al. ..... 162/112
5,908,534 A * 6/1999 Larsson et al. ..... 162/193
5,914,009 A * 6/1999 Kotitschke ..... 162/301
6,071,381 A * 6/2000 Leinonen ..... 162/217
6,113,740 A * 9/2000 Oriaran et al. ..... 162/112
6,159,341 A * 12/2000 Egelhof et al. ..... 162/303
6,231,723 B1 * 5/2001 Kanitz et al. ..... 162/280
6,267,846 B1 * 7/2001 Halmschlager et al. ..... 162/203
6,350,349 B1 * 2/2002 Hermans et al. ..... 162/111
6,454,904 B1 * 9/2002 Hermans et al. ..... 162/205
6,511,579 B1 * 1/2003 Edwards et al. ..... 162/111
6,558,510 B1 * 5/2003 Edwards et al. ..... 162/111
2002/0108732 A1 * 8/2002 Grabsoheid et al. ..... 162/302
2003/0024674 A1 * 2/2003 Kanitz et al. ..... 162/301
2003/0070781 A1 * 4/2003 Hermans et al. ..... 162/115
2003/0136531 A1 * 7/2003 Edwards et al. ..... 162/111
2003/0188842 A1 * 10/2003 Ronnenberg ..... 162/198
2004/0045691 A1 * 3/2004 Moser et al. ..... 162/301
2004/0060679 A1 * 4/2004 Shimazu ..... 162/300
2004/0129399 A1 * 7/2004 Weigant ..... 162/301

FOREIGN PATENT DOCUMENTS

CA 2448105 A1 * 5/2004

* cited by examiner

*Primary Examiner*—José A. Fortuna
(74) *Attorney, Agent, or Firm*—Alix, Yale & Ristas, LLP

(57) ABSTRACT

The invention relates to a device for detaching a paper web 9 from a wire 4, where the pulp suspension is fed in between a wire 4 and a felt 5 by a headbox 2, the wire 4 and felt 5 are guided together over a forming roll 3, and are separated from one another after the web 9 has formed. It is especially characterised by the separation point 10 of wire 4 and felt 5 being located at a distance from the forming roll 3.

10 Claims, 4 Drawing Sheets

DEVICE FOR DETACHING A PAPER WEB FROM A WIRE

BACKGROUND OF THE INVENTION

The invention relates to a device for detaching a paper web from a wire, where a pulp suspension is fed in between a wire and a felt by a headbox, the wire and felt are guided together over a forming roll, and are separated from one another after the web has formed.

A device of this kind is described, for example in U.S. Pat. No. 5,908,534. When they leave the roll, the wire and felt are separated from one another, while the paper web remains on the felt and is then brought to the drying plant. The disadvantage of the arrangement is that the felt sags after being separated from the wire, particularly at high machine speeds or large web widths, thus causing damage to the web. Also, the paper web is not always detached entirely from the wire. This causes clogging of the wire on the one hand, and repeated sheet breaks on the other.

SUMMARY OF THE INVENTION

The purpose of the present invention is to eliminate the disadvantage of such state-of-the-art plants by achieving exact detaching, even at relatively low felt tension and large machine widths and/or high machine speeds, while retaining the high quality of the paper web.

This is achieved according to the invention by locating the separation point of wire and felt at a distance from the forming roll. As a result, optimum felt tension can always be achieved at the same time as exact web detaching.

One implementation of the invention is in the form of an apparatus comprising: a paper web forming roll; a forming wire and a forming felf converging at one position on the forming roll; a headbox for feeding a pulp suspension between the forming wire and the felt at the convergence to form a paper web; means for maintaining the felt, paper web, and wire together in tension while the felt, paper web, and wire are carried by a portion of the forming roll, released together from the forming roll at another position on the forming roll, and travel together for a clearance distance to a separation point away from the forming roll; and means located at said separation point, for separating the wire from the felt.

It is an advantage if the separation point is designed as a suction roll with vacuum chamber, however it can also be designed as a suction shoe.

In an embodiment with a suction shoe, it has proved favourable if the suction shoe has one, advantageously several, particularly two suction slots.

If at least one web cutting device, particularly a movable cutting device, in particular edge trim nozzle(s) or tail cutter nozzle(s), is (are) provided in addition at the separation point of wire and felt, exact cutting can be achieved at the same time without influencing formation of the web. The web cutting device can also be located adjacent to the web between the forming roll and the separation point of wire and felt. In this case, the web cutting device can be designed such as to be movable in machine running or in cross-machine direction.

BRIEF DESCRIPTION OF THE DRAWINGS

The preferred embodiments of the invention will be described with reference to the examples shown in the accompanying drawings, wherein.

DESCRIPTION OF THE PREFERRED EMBODIMENTS

Figure 1:
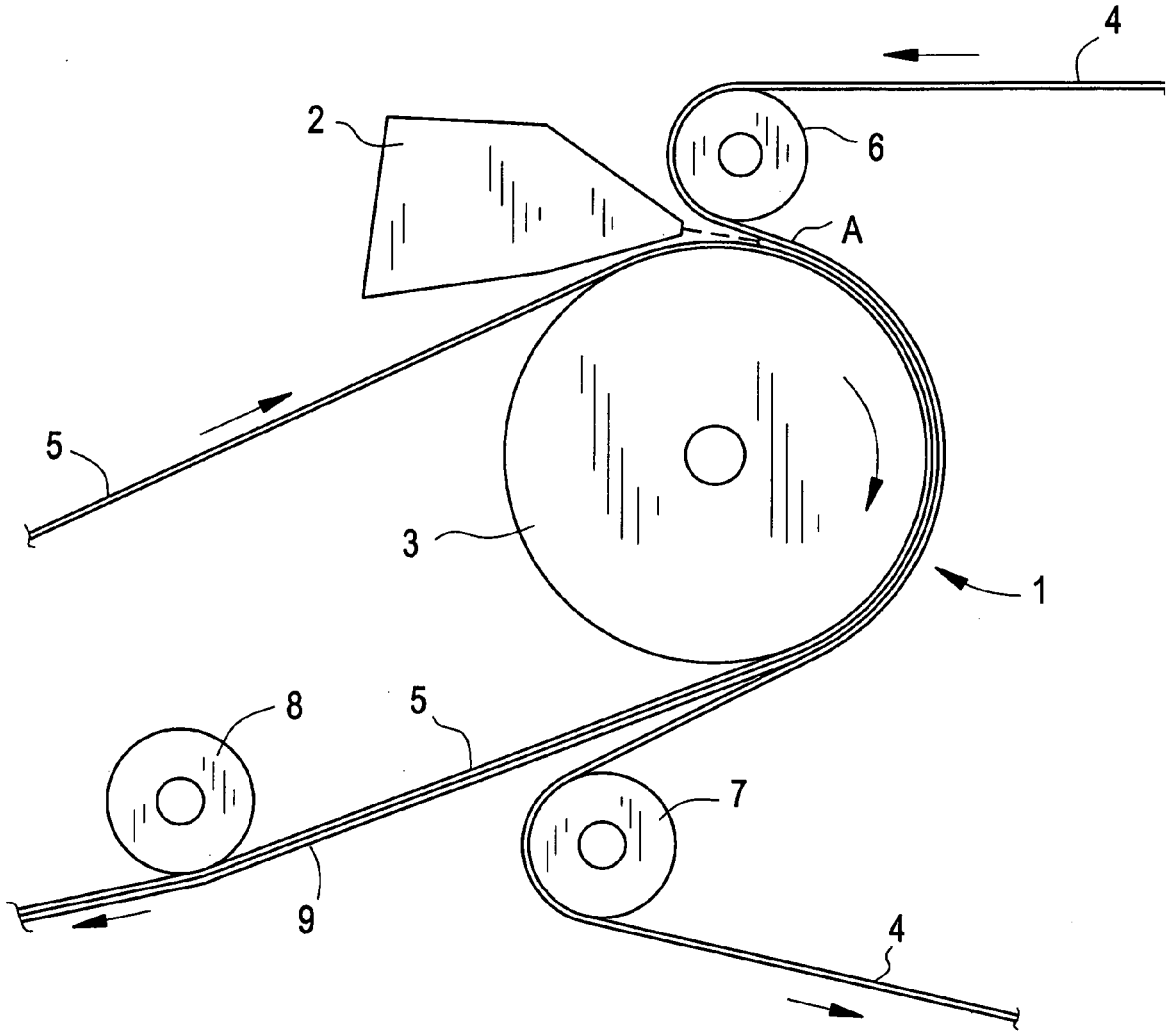
FIG. 1 shows a state-of-the-art plant.

FIG. 1 shows a cut-out from the wet section of a paper machine, for production of tissue grades for example. The wet section comprises a twin wire former 1 and a headbox 2. The twin wire former 1 is shown as a crescent former with a forming roll 3, a wire 4, and a felt 5. The wire 4 and felt 5 are run together over the forming roll 3. The wire 4 is guided over a breast roll 6 and, after separation, over a guide roll 7 located a short distance from the forming roll 3. After separation from the wire 4, the felt 5 is guided over a roll 8 together with the paper web 9 formed. In this type of plant, there is a risk at low felt tension, high speeds or large machine widths of frequent felt sagging, thus causing uneven contact with the wire 4, which leads to damage to the paper web or also to web breaks.

Figure 2:
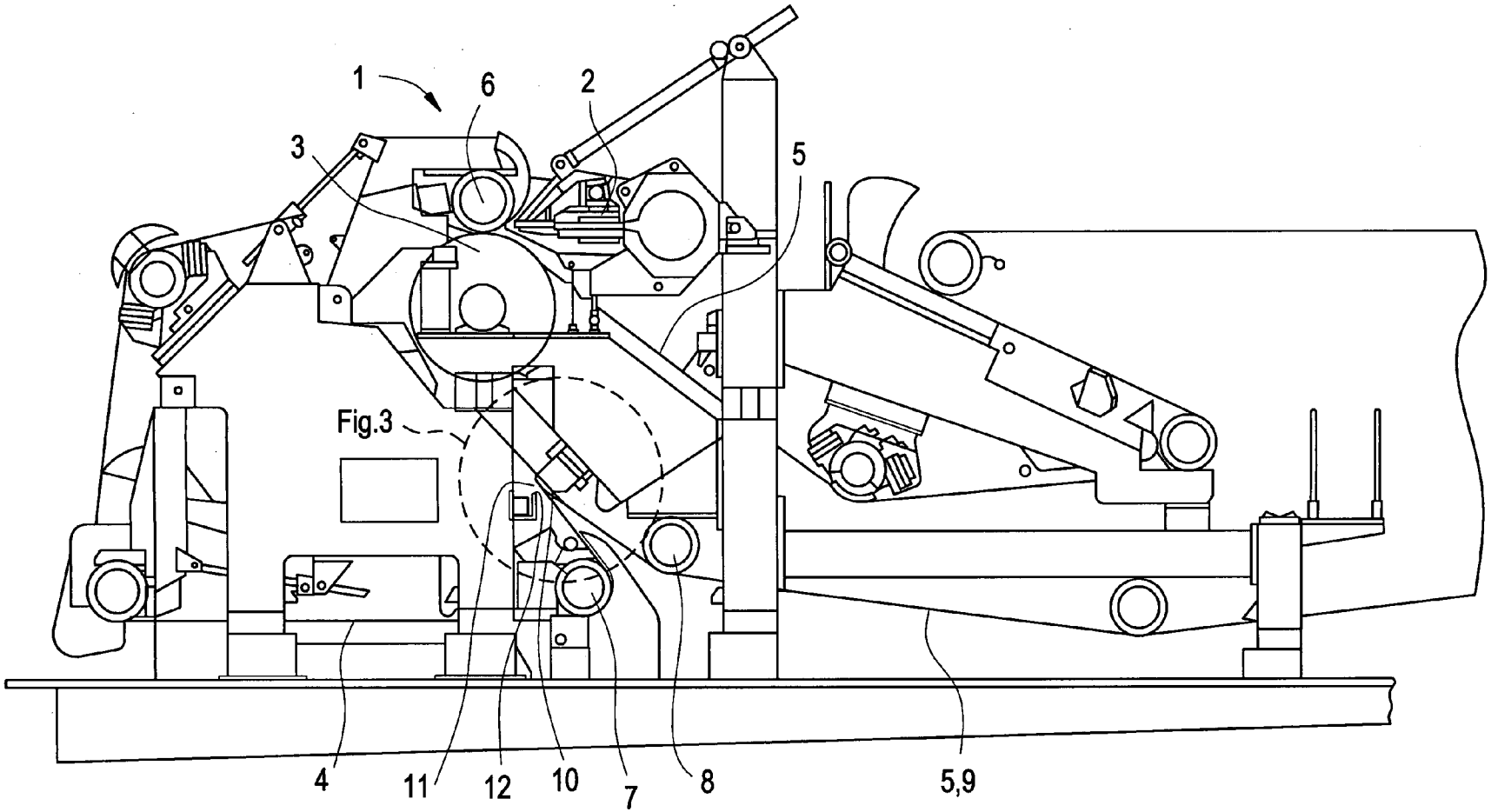
FIG. 2 shows a plant containing a device according to the invention.

In FIG. 2, a portion of a tissue manufacturing plant or mill is illustrated with the device according to the invention, where fabric travel is oriented counter clockwise instead of clockwise, but the corresponding parts are marked with the same references as in FIG. 1. Unlike the state of the art, the wire 4, felt 5 and the paper web 9 between the two are still together when they leave the forming roll and continue some distance together. In the prior art, the wire 4 separates from the felt 5 while the felt is still in contact with the forming roll 3, but according the invention they do not separate until they reach a separating point 10 located at a clearance distance from the forming roll 3. In FIG. 2 this clearance distance, as measured from the circumference of the forming roll, is equal to at least the radius of the forming roll (and preferably at least two times the radius). As a result, the circumference of the forming roll can be utilised for longer or the same forming times can be achieved at higher machine speeds, which means that the quality of the paper web is also retained at higher machine speeds. At the separation point 10, a suction shoe 11 is provided in this illustration. In addition, showers 12 for high-pressure water are shown for cutting the edge trim and feed strip.

Figure 3:
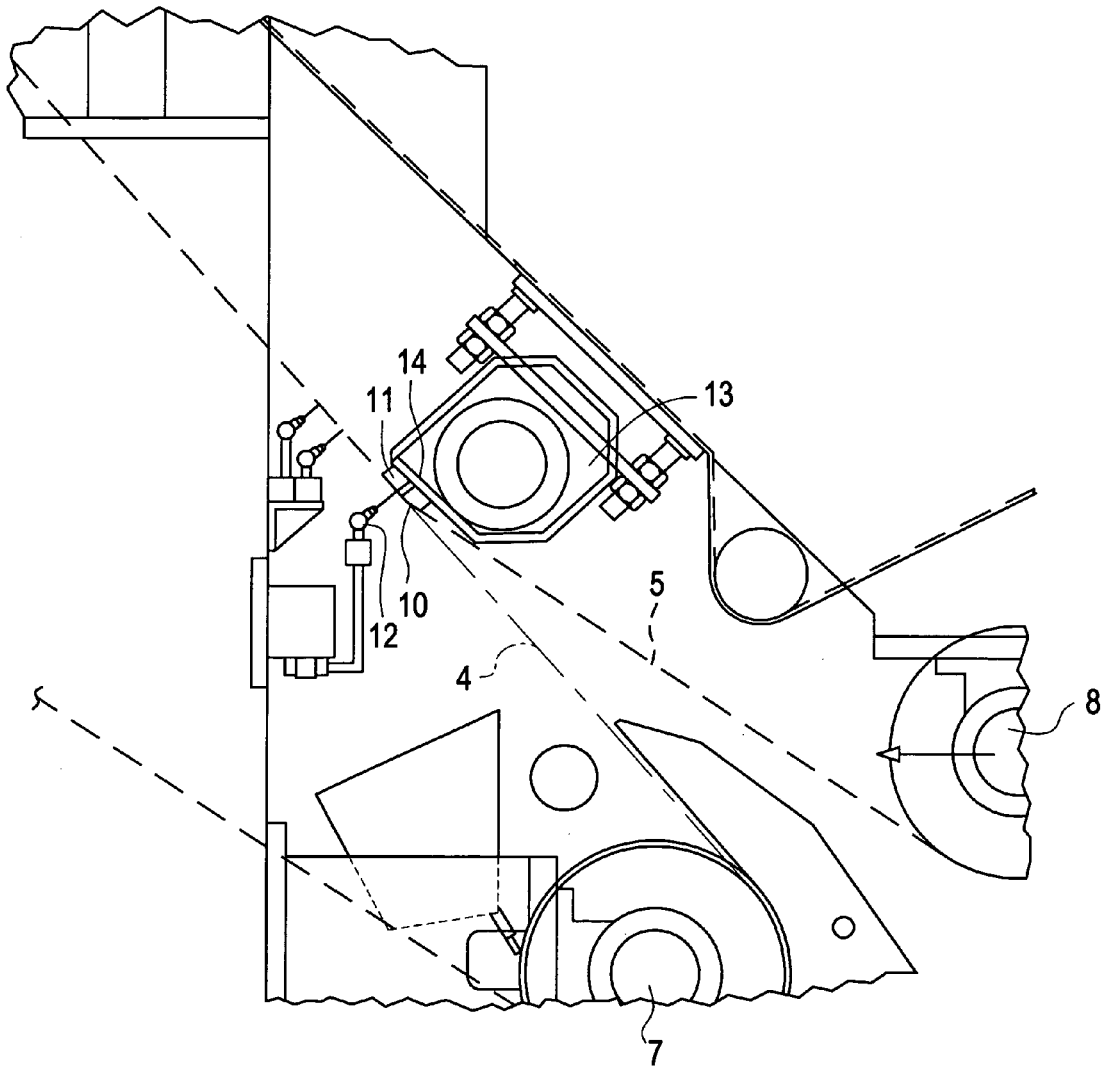
FIG. 3 shows a cut-out from FIG. 2.

FIG. 3 shows a cut-out from FIG. 2 marked there with a circle 111. Here, the separating point 10 is clearly visible. The wire 4 continues over a deflection roll 7, while felt 5 and paper web 9 are carried onwards over a deflection roll 8. The suction shoe 11 is connected to a suction pipe 13 and to openings 14, particularly a slot provided across the web running direction. If the edge trim or the feed strip is to be cut here, nozzles 12 are used with their jet directed into the slot 14 to prevent wetting the paper web 9 in any way and to carry off the water effectively. The jet can also be aimed at a point ahead of the slot 14. Of course, it would also be possible to provide two suction slots 14 one behind the other, which is particularly effective in separating removal of the spraying water by suction from adherence of the paper web by suction to the felt.

Figure 4:
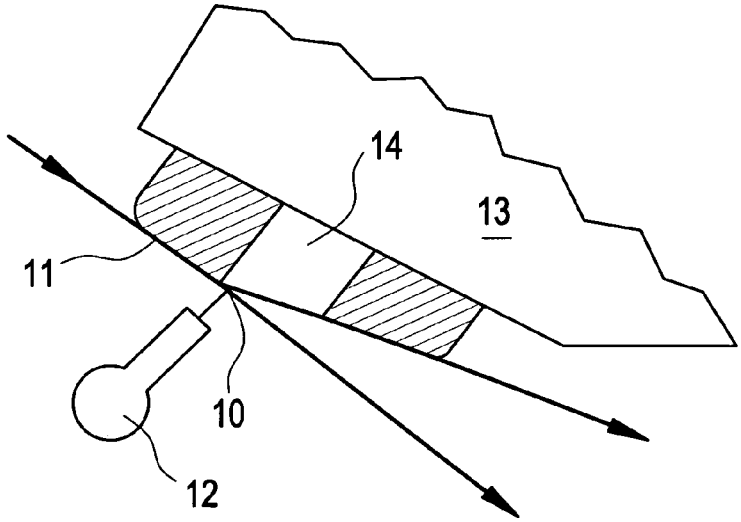
FIG. 4 shows a detail from FIG. 3.

FIG. 4 shows the separation point 10 once again in detail. Here the slot 14 in the suction shoe 11 is particularly clear. The separation point is preferably at the edge of the solid surface of shoe 11, which defines the slot 14, downstream of the forming roll. FIGS. 2 and 3 show that roll 8 is horizontally adjustable, which thus affects the tension of the felt 5 at the separation point 10.

Figure 5:
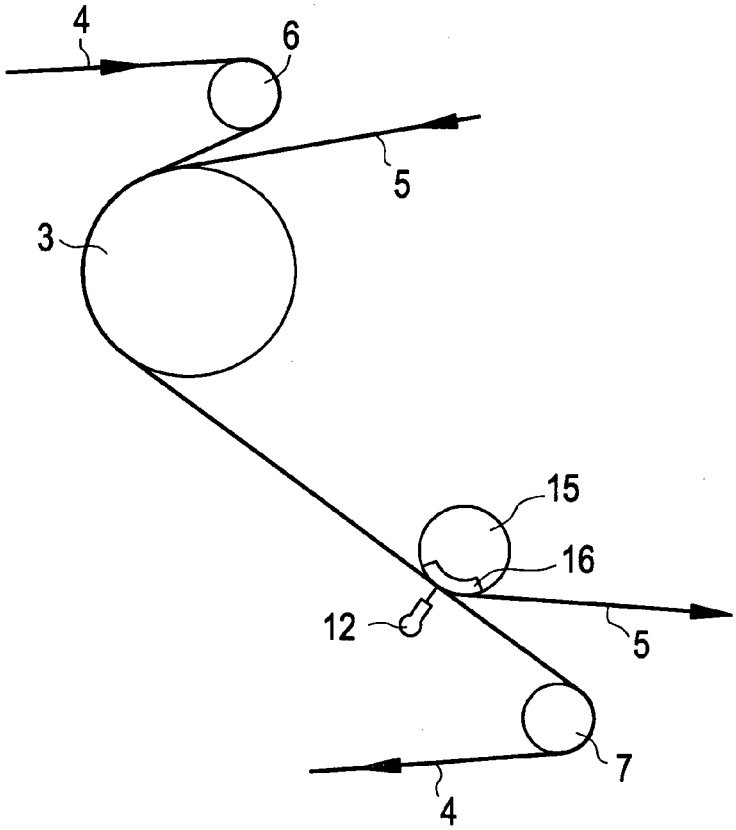
FIG. 5 illustrates an alternative embodiment of the invention.

FIG. 5 illustrates an alternative embodiment of the invention. Instead of the suction shoe, a suction roll 15 with a vacuum chamber 16 is used here. The advantage of this variant is the means of applying a vacuum to the felt, and thus also to the paper web, for a longer period. As a result, reliability of transfer of the paper web to the felt is enhanced even further.

The invention is not limited to the configurations illustrated. Thus, the high-pressure jet can also be mounted on a movable device as a so-called tail cutter in order to provide a strip for feeding the paper web into the paper machine, where the strip then broadens to cover the entire web width. Here, too, it would be feasible to use devices similar to the suction roll or suction shoe for detaching purposes.

What is claimed is:

1. In a paper manufacturing machine having a width and a headbox for feeding a pulp suspension between a forming wire and a felt at a forming roll, whereby the wire and felt are guided together over the forming roll to form the paper web, and apparatus for separating the felt with paper web from the wire after the web has formed, wherein the improvement comprises that in said apparatus, the separation point of the wire and the felt is located at a distance from the forming roll and at least one web cutting device is provided at the separation point of wire and felt, the web cutting device being movable across the width of the paper manufacturing machine.

2. Apparatus according to claim 1, wherein the separation point is at a suction roll with vacuum chamber.

3. Apparatus according to claim 2, wherein the web has a feed strip and including means having at least one nozzle to cut the feed strip.

4. Apparatus according to claim 1, wherein the separation point is at a suction shoe.

5. Apparatus according to claim 4, wherein the suction shoe has at least one suction slot.

6. Apparatus according to claim 1, wherein the web has a feed strip and including means having at least one nozzle to cut the feed strip.

7. Apparatus according to claim 1, wherein the separation point is spaced from the circumference of the forming roll, by a distance equal to at least two times the radius of the forming roll.

8. Apparatus according to claim 1, wherein the separation point is at a solid surface located between the forming roll and a felt deflection roll which maintains tension on the felt at the separation point.

9. Apparatus according to claim 8, wherein the felt is deflected at the separation point.

10. In a paper manufacturing machine having a headbox for feeding a pulp suspension between a forming wire and a felt at a forming roll, whereby the wire and felt are guided together over the forming roll to form the paper web, and apparatus for separating the felt with paper web from the wire after the web has formed, wherein the improvement comprises that in said apparatus, the separation point of the wire and the felt is located at a distance from the forming roll and at least one web cutting device is provided at the separation point of wire and felt, the at least one web cutting device being one of an edge trim water jet nozzle or a tail cutter water jet nozzle.

* * * * *